US008833878B2

(12) United States Patent
Lam et al.

(10) Patent No.: US 8,833,878 B2
(45) Date of Patent: Sep. 16, 2014

(54) DRAWER GUIDE RAIL SYSTEM

(75) Inventors: Harn Lian Lam, Perak (MY); Harn Yan Lam, Perak (MY)

(73) Assignee: Ham Marketing SDN, BHD (MY)

( * ) Notice: Subject to any disclaimer, the term of this patent is extended or adjusted under 35 U.S.C. 154(b) by 91 days.

(21) Appl. No.: 13/702,406

(22) PCT Filed: May 24, 2011

(86) PCT No.: PCT/MY2011/000056

§ 371 (c)(1),
(2), (4) Date: Dec. 6, 2012

(87) PCT Pub. No.: WO2012/015294

PCT Pub. Date: Feb. 2, 2012

(65) Prior Publication Data

US 2013/0076219 A1 Mar. 28, 2013

(30) Foreign Application Priority Data

Jul. 29, 2010 (MY) ..... PI 2010003593

(51) Int. Cl.
*A47B 88/04* (2006.01)
*A47B 88/14* (2006.01)

(52) U.S. Cl.
CPC ..... *A47B 88/14* (2013.01); *A47B 2210/0091* (2013.01); *A47B 88/047* (2013.01)
USPC ..... 312/333; 312/319.1

(58) Field of Classification Search
CPC ..... A47B 88/047; A47B 88/14; A47B 88/04; A47B 2210/0059; A47B 2210/0091
USPC ..... 312/330.1, 333, 319.1, 334.1, 334.7, 312/334.8, 334.44, 334.47; 384/20, 21, 22
See application file for complete search history.

(56) References Cited

U.S. PATENT DOCUMENTS 6,846,053 B2 * 1/2005 Salice ..... 312/334.14
2003/0234604 A1 * 12/2003 Lin ..... 312/334.6

(Continued)

*Primary Examiner* — James O Hansen
(74) *Attorney, Agent, or Firm* — Renner Kenner Greive Bobak Taylor & Weber

(57) ABSTRACT

A guide rail system for slidably opening and closing a drawer within an enclosure is disclosed. The system comprises a mounting bracket for fixing the system to the enclosure, the mounting bracket having a fixed rail for receiving an intermediate rail capable of sliding back and forth on the fixed rail, and a pull out rail operatively attached to the drawer and capable of sliding back and forth on the intermediate rail. A resiliently compressible damping device, channel guide with sliding member and a closing device are disposed along the mounting bracket. The pull out rail has a guiding pin on its bottom surface. The sliding member is adapted to travel along the channel guide and locate an end of the damping device that can be pushed inwardly to provide damping. The closing device comprises a housing, a resilient means, and a driver pivotally mounted with the housing and operatively connected to the resilient means. The driver is pivotable between a first locked position and a second linearly moveable position, and includes an angular slot for receiving the guiding pin and an abutment projection contactable with the sliding member. During a closing action, the pull out rail is caused to slide in a drawer-closing direction. When the guiding pin reaches and engages with the angular slot, the action of the guiding pin within the angular slot causes the driver to be pivoted from its first position to its second position where the abutment projection engages with the sliding member. Thereafter, linear movement of the driver urges the sliding member to correspondingly travel along the channel guide against the resilience of the damping device, resulting in deceleration of the closing motion.

16 Claims, 8 Drawing Sheets

(56) References Cited

U.S. PATENT DOCUMENTS

2007/0101539 A1 5/2007 Sutterlutti et al.
2007/0132346 A1* 6/2007 Huang ..... 312/333
2007/0278917 A1* 12/2007 Yang ..... 312/330.1
2007/0278919 A1* 12/2007 Lu ..... 312/333
2009/0230830 A1* 9/2009 Ng ..... 312/333
2009/0273129 A1* 11/2009 Zimmer et al. ..... 267/170
2009/0273263 A1* 11/2009 Berger ..... 312/334.1
2009/0278430 A1* 11/2009 Liang et al. ..... 312/319.1
2009/0309470 A1* 12/2009 Ruter ..... 312/334.1
2010/0123378 A1 5/2010 Chen et al.

* cited by examiner

DRAWER GUIDE RAIL SYSTEM

This invention relates to a drawer guide rail system.

More particularly, this invention relates to a drawer guide rail system having a closing device to aid in the drawer closing motion and a damping device for deceleration of a drawer closing motion.

DESCRIPTION OF THE PRIOR ART

Drawer guide rails are components in common every day use, such as for drawers in desks or cabinets, and for industrial use such as pull out storage shelves at a warehouse, cash registers at a supermarket, automated teller machines at banking kiosks, electronic equipment at telephone switching stations and so on.

Guide rail systems are provided for drawers to be either partially or fully opened or closed and typically consist of a bracket for fixing the system to the article of furniture, a fixed rail mounted on the bracket, a pull-out rail attached to the side of the drawer, and preferably an intermediate rail in between the fixed and pull-out rails. The intermediate rail is slidable over the fixed rail and the pull-out rail is slidable over the intermediate rail normally due to slidable roller housings disposed within the fixed and pull-out rails. Each of the fixed, intermediate and pull-out rails is also normally disposed with pairs of limit stoppers. The distance traveled by the slidable roller housings between each pair of limit stoppers on each rail element typically defines the travel distance of each rail.

When a drawer having this typical guide rail system is pushed in or closed with excessive force, it may roll forward again or rebound because of the excessive force used. Also, a drawer that has been moved to a closed position will sometimes not be fully closed and the front panel of the drawer projects from the furniture body. As a result, it is possible for persons to bump against the front panel and injury may occur.

Further, loud noise would also oftentimes be produced as a result of contact and movement between the rail elements as well as sliding housings of a guide rail assembly. Also excessive force used on the assembly, results in accelerated and uncontrolled closing motion which would damage the rail elements of the assembly and the article of furniture.

Hence, a guide rail assembly that incorporates a closing device to aid in the drawer-closing motion and allows for aided and controlled decelerated closing motion of a drawer was developed and disclosed in Malaysian utility innovation application no. UI 20093357.

In this prior rail assembly, a mounting bracket having a fixed rail, an intermediate rail and an outer pull out rail is provided. As per the typical guide rail system explained above, roller housings are provided so as to enable the intermediate rail and outer pull out rail to be slidable. A protrusion and a guiding pin is provided on the bottom surface of the outer pull-out rail.

A fluid damper and a channel guide having a sliding member are disposed end-to-end on the mounting bracket, the sliding member being contactable by the pull out rail protrusion. A distal end of the damper rod is located within the sliding member.

A closing device is provided on the mounting bracket adjacent its fixed rail. The closing device comprises an elongate hollow housing, a locking step, a rotating member slidably mounted in the front portion of the housing and a resilient means mounted in the rear portion of the housing and coupled to the rotating member. The rotating member has an angular slot to receive the guiding pin of the pull out rail.

During a drawer closing motion, the outer pull out rail is caused to slide in a drawer-closing direction. At a predetermined point, the pull out rail protrusion reaches and engages with the sliding member. At the same time, the guiding pin engages with the angular slot of the closing device rotating member. Thereafter, further closing of the pull out rail (drawer) is aided by the closing device. The rotating member is anchored at its locking step, in front of its housing, when engaged by the guiding pin. Action of the guiding pin within the angular slot causes rotation of the rotating member, which frees it from its locking step and allows it to be pulled axially through the housing by the resilient means. The rotating member is prevented from rotating during axial movement. Engagement of the pull out rail protrusion with the sliding member urges it to travel within the channel guide against the resilience of the fluid damper, hence, causing deceleration of the drawer-closing motion.

In use, it has been observed that the closing device of this prior assembly periodically fails, when it is used with a large and/or heavily loaded drawer, and especially when excessive force is used in pushing in the drawer. The successful function of the closing device of this prior assembly is dependent on accurate insertion of the pull out rail guiding pin within its rotating member angular slot. Any inaccuracy in that insertion, either due to manufacturing irregularities, assembly error and/or excessive drawer closing force, will result in failure of the closing device.

Failure of the closing device will inevitably affect the efficiency of the deceleration mechanism (damping device and channel guide), which leads to noise and damage to the drawer and article of furniture and rail elements of the guide rail assembly in the long run.

Further, the design of this closing device also unnecessarily complicates the manufacturing and assembly of this prior guide rail assembly.

This invention thus aims to alleviate some or all of the problems of the prior design.

SUMMARY OF THE INVENTION

In accordance with an aspect of the invention, there is provided a guide rail system for slidably opening and closing a drawer within an enclosure. The system comprises a mounting bracket for fixing the system to the enclosure, the mounting bracket having a fixed rail for receiving an intermediate rail; an intermediate rail capable of sliding back and forth relative to the mounting bracket fixed rail; and a pull out rail for attachment to the drawer and being capable of sliding back and forth on the intermediate rail. The pull out rail has a guiding pin on its bottom surface. A damping device and a channel guide are disposed along the mounting bracket. The damping device is resiliently compressible in a lengthwise direction and the channel guide has a sliding member adapted to travel along the channel guide and locate an end of the damping device that can be pushed inwardly to provide damping. A closing device is disposed along the mounting bracket, and comprises a housing, a resilient means disposed within the housing, and a driver pivotally mounted with the housing and operatively connected to the resilient means. The driver is pivotable between a first locked position and a second linearly moveable position, and includes an angular slot for receiving the guiding pin and an abutment projection contactable with the sliding member. During a closing action, the pull out rail is caused to slide in a drawer-closing direction. When the guiding pin reaches and engages with the angular slot, the action of the guiding pin within the angular slot causes the driver to be pivoted from its first position to its second position where the abutment projection engages with the sliding member. Thereafter, linear movement of the driver urges the sliding member to correspondingly travel along the channel guide against the resilience of the damping device, resulting in deceleration of the closing motion. The driver further comprises a resilient tongue contactable with the guiding pin when the driver is caused to pivot from its first position to its second position without engagement of the pin within the angular slot.

In an embodiment, the damping device may comprise a cylinder body and a rod that is pushable into the cylinder body when the device is compressed with the distal end of the rod being located in the sliding member. The damping device may be a fluid damper.

In a further embodiment, the channel guide has an open top such that the sliding member extends through the open top of the channel guide and locates an end of the damping device through a longitudinal end of the channel.

According to an embodiment, the sliding member may further comprise a chamber for receiving the end of the damping device.

The sliding member may further comprise an abutment face contactable with the abutment projection of the closing device driver. The aperture and abutment face may be disposed on opposing ends of the sliding member.

In another embodiment, the closing device may be disposed to a side of the damping device and channel guide, on the mounting bracket.

According to a further embodiment, the closing device housing may be C-shaped and comprise of a pair of side flanges and a top flange. A bracket may be provided on one of the side flanges for removably attaching the damping device to the closing device.

According to yet another embodiment, the closing device housing may further comprise a recess for receiving the driver. The recess may be provided with a lip portion and the driver may be provided with a corresponding hook portion engageable with the lip portion, to lock the driver in its first position.

In a further embodiment, the driver may further comprise a catch for receiving an end of the resilient means. Both the catch and the end of the resilient means received therein are suitably shaped so as to enable the driver to be pivotable about that point.

In another embodiment, the driver may further comprise a guide groove, with a housing side flange insertable within the groove, in use, for guiding the pivoting movement of the driver.

According to an embodiment, the driver may further comprise a resilient tongue contactable with the pull out rail guiding pin, in use.

According to yet another embodiment, the intermediate rail may comprise a C-shaped guide that is slidable along the mounting bracket fixed rail and a channel piece disposed on top of the C-shaped guide, whereby the pull out rail is slidable along the channel piece of the intermediate rail.

In an embodiment, the fixed rail and pull out rail each may further comprise a slidable housing having a plurality of rollers that enables the intermediate rail to be slidable on the fixed rail and the pull out rail to be in turn slidable on the intermediate rail.

The objective of the drawer guide rail system of this invention is to provide a reliably aided, quiet, controlled and decelerated drawer-closing motion with a system of a sufficiently robust design to withstand excessive drawer-closing force without the need for frequent replacements of drawer or guide rail elements.

Usage of a pivotable driver in the closing device of the guide rail system of this invention, rather than a rotating member, advantageously significantly reduces and quite possibly eliminates failure of the closing device. This is because the function of the closing device (driver) is not dependent on accurate insertion of the pull out rail guiding pin within its angular slot.

This also allows the closing device (guide rail system) to be highly tolerant of manufacturing irregularities and/or assembly errors, since as mentioned above its function is no longer dependent on insertion (accurate or otherwise) of the pull out rail guiding pin into the angular slot.

Reliable and improved function of the closing device would also result in improved efficiency in deceleration of the drawer closing motion (by the damping device and channel guide) as well as decreased likelihood of damage to the elements of the guide rail system.

Assembly and manufacture of the guide rail system of this invention are also significantly eased with this closing device design in comparison with that of the prior design.

BRIEF DESCRIPTION OF THE DRAWINGS

The invention is illustrated, although not limited, by the following description of embodiments made with reference to the accompanying drawings in which.

DETAILED DESCRIPTION OF THE EMBODIMENTS

Figure 1:
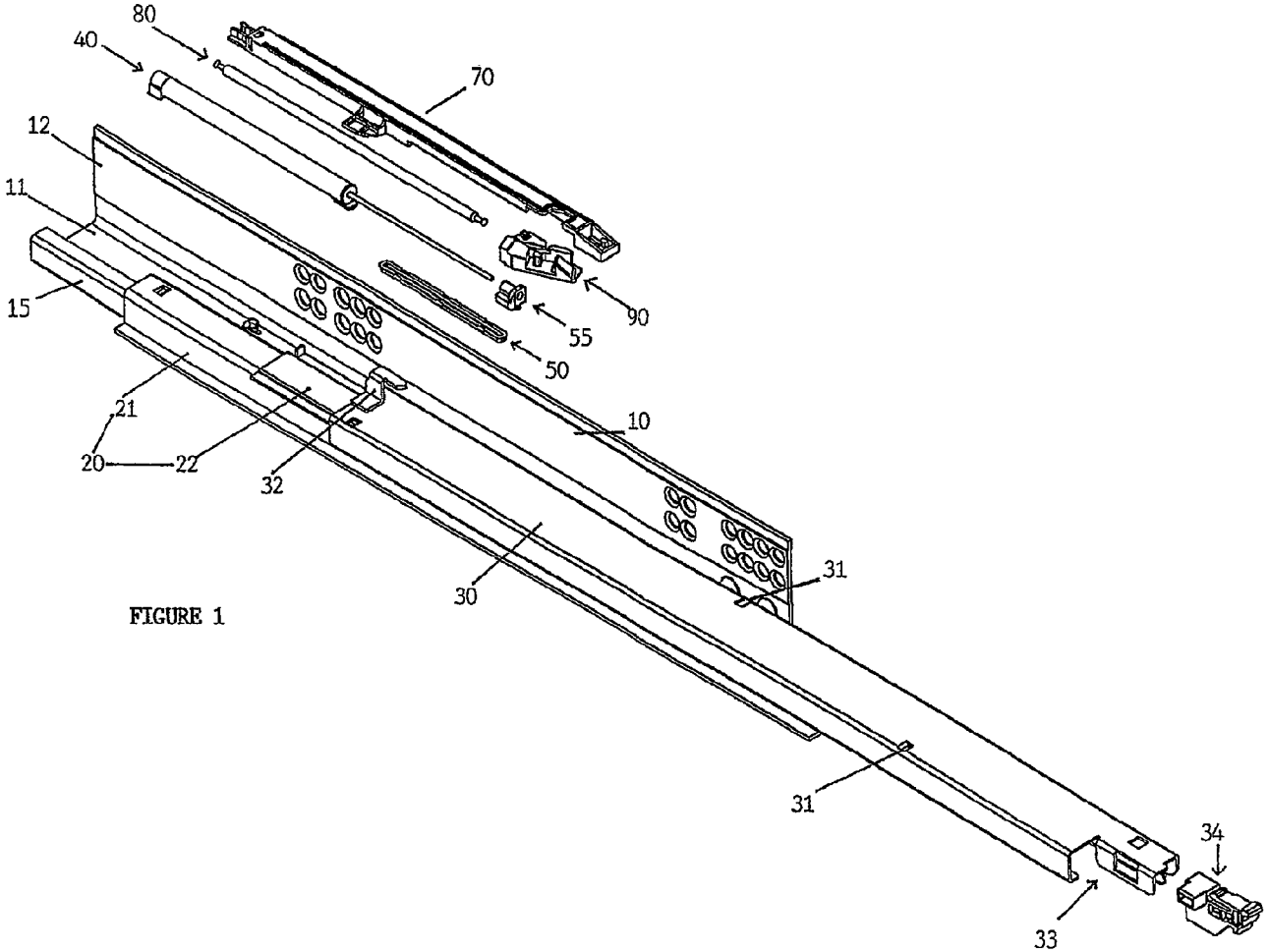
FIG. 1 shows a perspective view of a sliding guide rail system according to an embodiment of this invention, in a partially extended position.

FIGS. 1 to 8 show an embodiment of a drawer guide rail system according to the present invention. This guide rail system comprises of a mounting bracket 10 for fixing the drawer to the article of furniture, the mounting bracket 10 having a fixed rail 15, an intermediate rail 20 and a pull out rail 30 secured to the drawer. The fixed rail 15 and pull out rail 30 each have a slidable housing (not shown) having a plurality of rollers, which enables the intermediate rail 20 to be slidable on the fixed rail 15 and the pull out rail 30 to be in turn slidable on the intermediate rail 20. A damping device 40 and a channel guide 50 with sliding member 55 are mounted on and along the mounting bracket 10 adjacent the fixed rail 15. Also mounted on the mounting bracket 10 is a closing device 60, which comprises of a housing 70, a resilient means 80 and a pivotable driver 90 that operatively interacts with the sliding member 55 (channel guide 50) and damping device 40 to initiate deceleration of the drawer closing motion.

Figure 2:
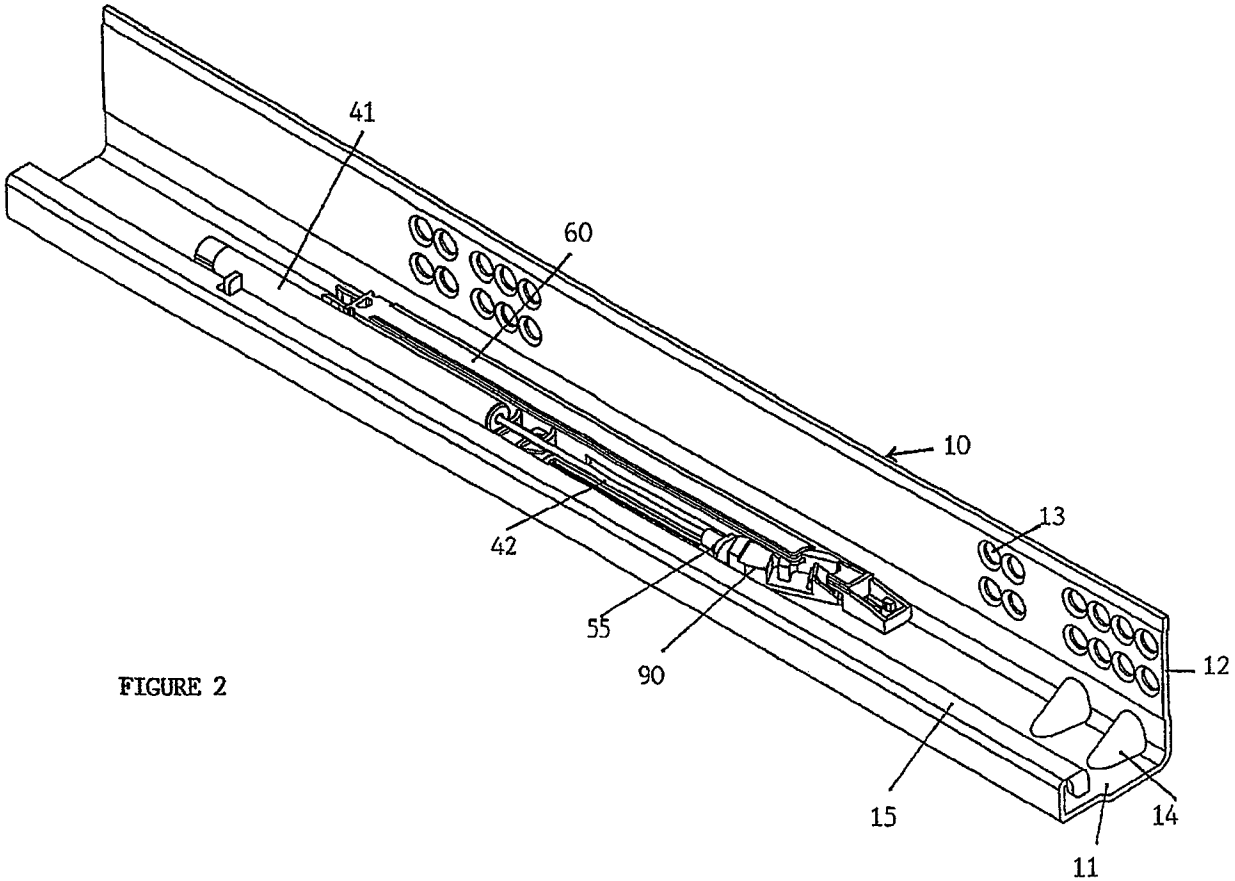
FIG. 2 is a perspective view of the assembly of FIG. 1 (the pull out rail, and intermediate rail has been removed to show the interaction between the damping device, channel guide, sliding member and closing device).
Figure 3:
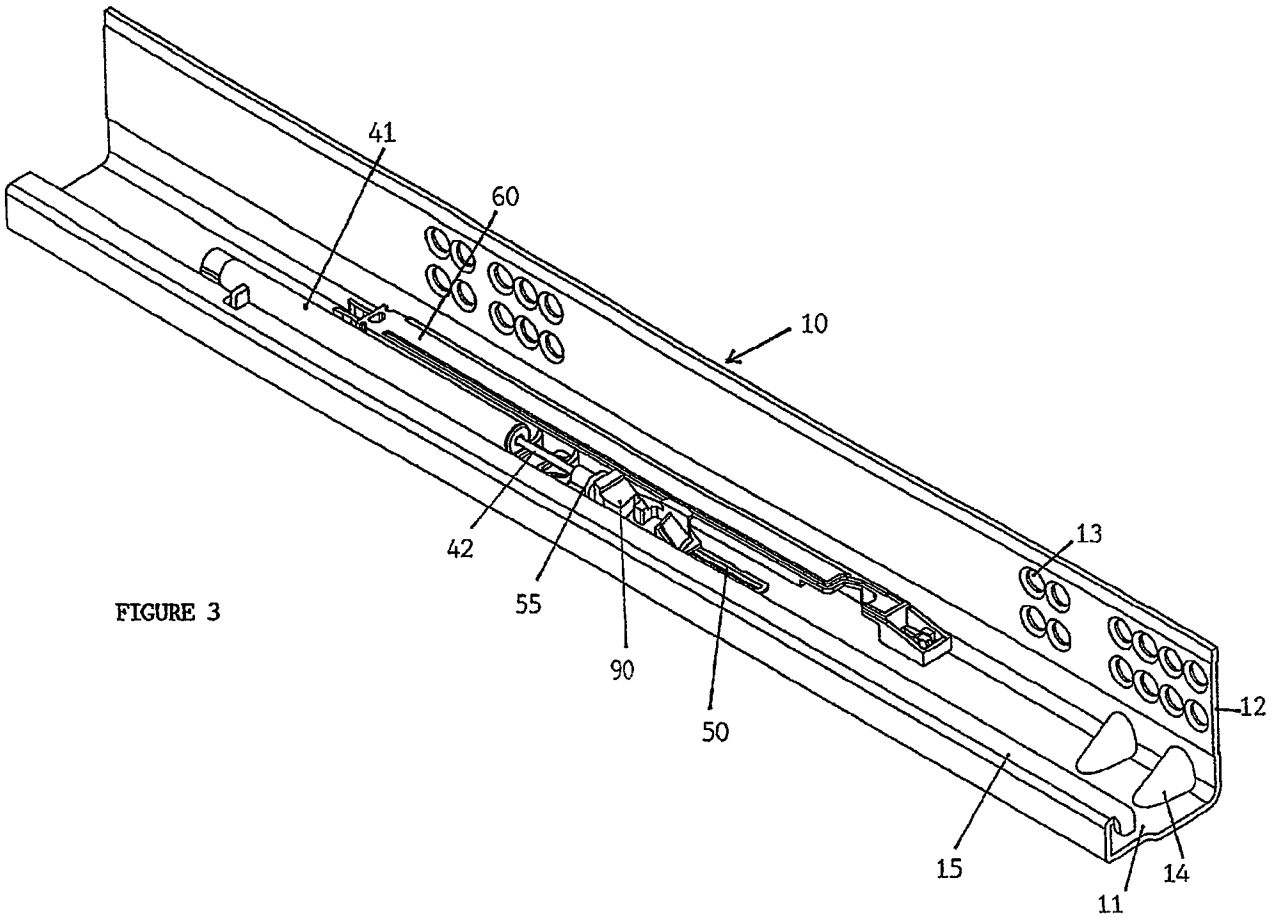
FIG. 3 shows the assembly of FIG. 2, in a fully retracted position (drawer fully closed).
Figure 4:
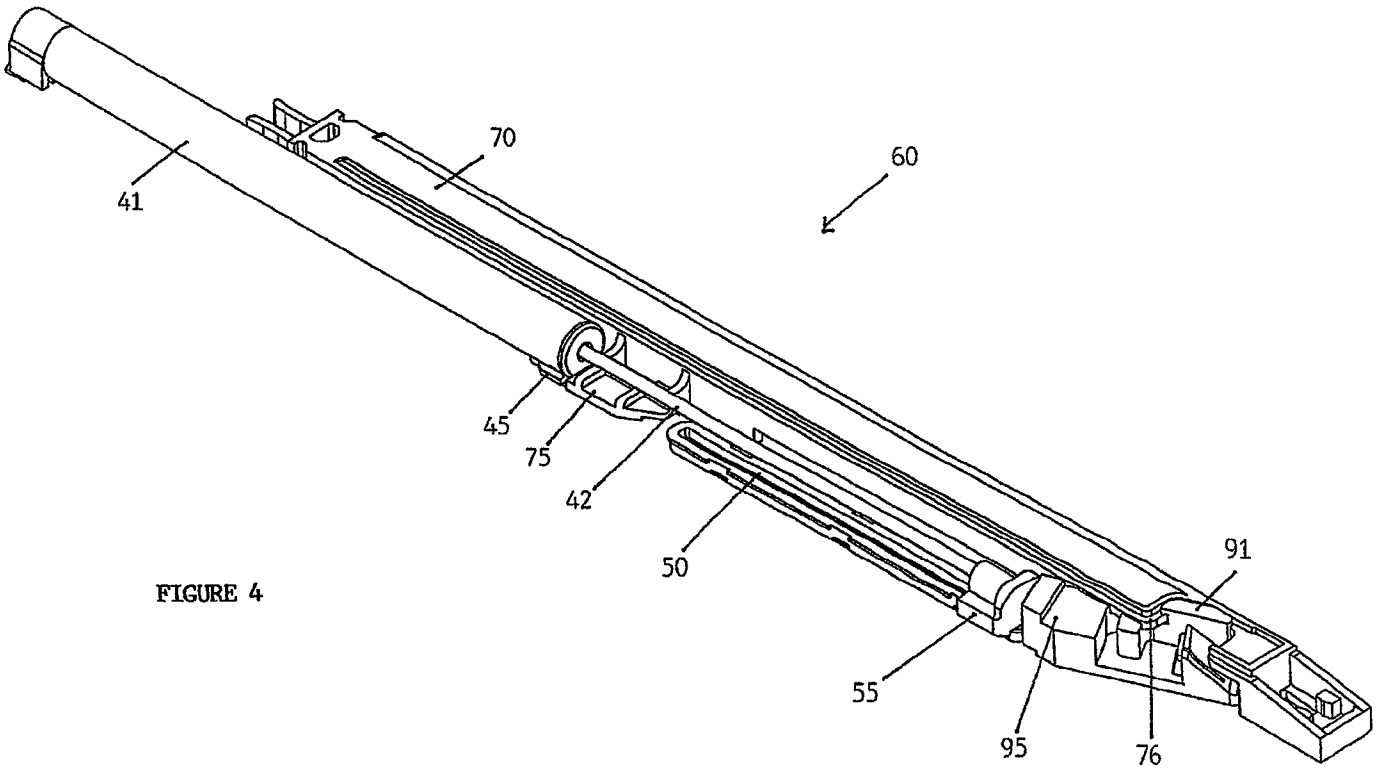
FIG. 4 shows the closing device, damping device and channel guide of FIG. 1, as assembled.

As shown in FIGS. 1 to 3, the mounting bracket 10 is formed from sheet metal into an L-section with the upper free edge of the horizontal flange 11 of the L-section bent upwardly to form a fixed rail 15 having a running surface for the sliding housings (described below). The height of the fixed rail 15 is significantly less than the height of the vertical flange 12 of the L-section mounting bracket. The fixed rail 15 also has a folded up metal tab at its rear longitudinal end (relative to drawer orientation) that functions as a limit stopper for the sliding housing (described below) that slides thereon. The vertical flange 12 of the mounting bracket 10 is provided with a multitude of holes 13 for fixing to the side of an article of furniture, and has stepped edges formed thereon and notches at the bent edge of the L-section for increasing the rigidity and load capacity of the bracket 10. When in use, the mounting bracket 10 bears the whole weight of the drawer load. The fixed rail 15 will be subjected to tremendous load force when a drawer is heavily loaded. Hence, in guide rail systems designed for heavy-load drawers, several strengthening corner settings 14 are preferably added at the adjoining portion of the vertical and horizontal flanges 12, 11 of the mounting bracket 10.

The damping device 40 and channel guide 50 with sliding member 55 are longitudinally mounted on the horizontal flange 11 of the mounting bracket 10 adjacent the fixed rail 15. Also mounted on the mounting bracket 10 is a closing device 60. A stopper tab (not shown) is provided on the horizontal flange 11 of the L-section adjacent and between the channel guide 50 and fixed rail 15. The stopper tab is located such that it is forward relative to the rear travel limit position of the sliding member 55 within the channel guide 50.

The intermediate rail 20 seen in FIG. 1 consists of an open C-shaped guide 21 having unequal sides that is slidable along the mounting bracket fixed rail 15 and a channel piece 22 disposed on top of the C-shaped guide 21. At the upper and rear ends of each side of the C-shaped guide 21 is a punched out tab (not shown) that extends inwards and serves as a travel limit stopper for the fixed rail sliding housing (not shown). The channel piece 22 is preferably a substantially planar metal plate that is detachably mounted on top of the C-shaped guide 21 and slidably receives the pull out rail 30 thereon. Also, the channel piece 22 has a step on each side, thereby defining a shoulder on each side of the channel piece 22, for guiding and stabilizing the sliding motion of the pull out rail 30. The width of this channel piece 22 is therefore, preferably considerably more than that of the C-shaped guide 21 but slightly less than that of the pull out rail 30. A punched out tab functioning as a limit stopper for the sliding housing of the pull out rail 30 is also provided at the upper end of the channel piece 22.

As seen in FIG. 1, the pull out rail 30 is formed from a sheet metal into an open C-section. On either side of this pull out rail 30 are two stops 31 disposed such that each stop 31 is located towards a longitudinal end of the rail 30. These stops 31 consist of punched-out tabs that bend inwardly. An L-shaped extension 32 is cut or formed on the upper surface of this pull out rail 30. This extension 32 engages with an aperture (not shown) at the back of the drawer for fixing the pull out rail 30 to the drawer. An aperture (not shown) is also punched on the side of this pull out rail 30 at the front end (relative to drawer orientation) to allow for engagement with a catch (not shown) mounted on the bottom of the drawer. This allows for the drawer to be easily and removably attached with the pull out rail 30. Slidably fitted inside this pull out rail 30 is a sliding housing (not shown) having rollers which allows it to run smoothly inside the pull out rail 30 between the stops. A guiding pin 35 for engagement with the closing device 60 (driver 90) is provided on the bottom surface of the pull out rail 30.

One side of the front longitudinal end of this pull out rail 30 comprises an open space formed by bending a side portion of the rail top surface downwards. A cut-in recess 33 is provided on the other side of the pull out rail front end. An opening is provided on the top surface of the rail, adjacent the bent-down portion, for receiving an attachment tab of the stopper piece 34 which will be described below.

As seen in FIG. 1, a stopper piece 34 is provided on the bottom surface, toward the front end (relative to drawer orientation), of the pull out rail 30. The stopper piece 34 is preferably removably mounted on the bottom surface of the rail 30. The stopper piece 34 comprises a pair of attachment tabs on its top and the bottom surface at a front end of the pull out rail 30 has a pair of corresponding apertures for receiving the stopper piece attachment tabs. The stopper piece 34 is a substantially rectangular block with its rear longitudinal end comprising an abutment surface. The abutment surface is engagable with the mounting bracket stopper tab. Engagement of the abutment surface of the stopper piece with the stopper tab defines the rear travel limit of the pull out rail 30.

The sliding housings (not shown) of both the fixed rail 15 and pull out rail 30 are of a similar construction and comprise a long member having a substantially rectangular cross-section with a hollow central recess. Rollers are provided at the upper part and both sides of the recess. The side rollers are vertically displaced by a distance substantially equal to the thickness of the vertical web of the intermediate rail. The number, type (whether upper or side rollers) and configuration of rollers depend on the load capacity for which the sliding housings are designed. Further side rollers (not shown) that provide lateral guidance for the drawer/equipment may also be provided, wherein when these rollers are spaced as far apart as possible, greater lateral stability is provided. The open recess of the intermediate rail-sliding housing enables the intermediate rail 20 to be slidable on the fixed rail 15 with the lower flange of the rail slidably fitted therein. Similarly, the open T-shaped recess of the pull out rail-sliding housing enables the pull out rail 30 to be slidable on the intermediate rail 20 with the upper flange of the rail slidably fitted therein. Adequate clearances are provided between the upper rollers and the respective contact surfaces of both the upper and lower flanges of the intermediate rail 20 for ease of alignment and/or assembly. Similarly, adequate clearances are provided between side rollers and the contact surfaces of the vertical web of the intermediate rail 20.

Both the damping device 40 and channel guide 50 with sliding member 55 are located longitudinal end to longitudinal end relative to each other with the damping device 40 in a rear position and the channel guide 50 in a front position, both rear and front positions being relative to drawer orientation within the article. A punched out metal tab with aperture and slots (not shown) is provided on the horizontal flange 11 of the mounting bracket 10 to aid in firmly holding the damping device 40 and channel guide 50.

The damping device 40 (FIGS. 4 and 5) is resiliently compressible in a lengthwise direction and comprises a cylinder body 41 with a rod 42 that is pushable into the cylinder body 41 when the device is compressed. The damping device 40 is oriented such that the distal end of the rod 42 is locatable in the sliding member 55 of the channel guide 50. A pair of attachment brackets 45 is provided on the longitudinal ends of the cylinder body 41 with the rear bracket having a protruding tab for engagement with the mounting bracket metal tab and aperture, and the front bracket being engagable with a side bracket 75 of the closing device housing 70. Although, a fluid damper is preferred for use with the assembly of this invention, the damping device 40 may also easily comprise an air damper.

The channel guide 50 (FIGS. 4 and 5) is a substantially rectangular elongate channel with an open top. Preferably, the channel portion 51 of the guide 50 is of uniform width throughout its length. A longitudinal end of the channel portion 51 faces the rod 42 of the damping device 40. Attachment means (not shown) provided on the bottom of the guide 50 is engaged into corresponding receiving apertures (not shown) on the horizontal flange 11 of the mounting bracket 10. The channel guide 50 is thus, firmly mounted on the mounting bracket 10.

Figure 7B:
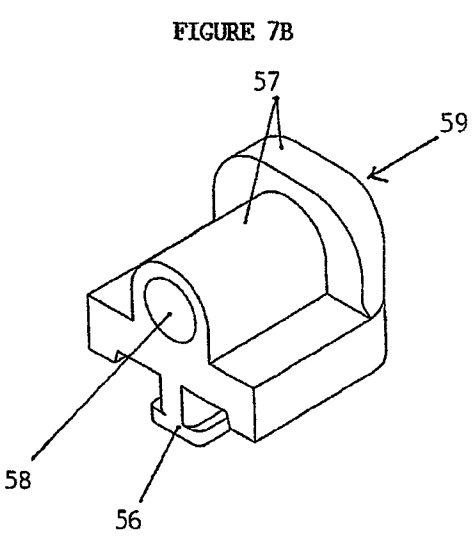
FIGS. 7A and 7B show front and rear views of the sliding member of the channel guide of FIG. 1.
Figure 7A:
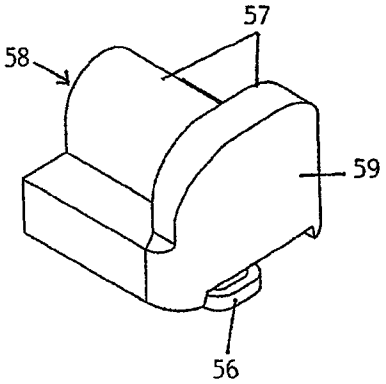

As seen in FIGS. 7A and 7B, the sliding member 55 comprises a lower portion 56 and an upper portion 57. The lower portion 56 of the sliding member 55 is slidably mounted within, and, is slidable along the channel portion 51 of the guide 50. The upper portion 57 of the sliding member 55 extends through the open top of the guide 50. The rear face of the sliding member upper portion 57 is provided with a chamber 58 for receiving the distal end of the damping device rod 42. The front face of the sliding member upper portion 57 comprises an abutment face 59 engagable with the abutment projection 95 of the closing device driver 90. When fully extended, the damping device rod 42 runs along the length of the channel portion 51 of the guide 50.

A drawer closing device 60, as shown in FIGS. 2 to 5, is provided on the mounting bracket horizontal flange 11, preferably, between its vertical flange 12 and the longitudinal arrangement of the damping device 40 and channel guide 50. The closing device 60 aids in the drawer-closing motion i.e. sliding motion of the pull out rail 30 in a drawer-closing direction, and comprises a housing 70, a resilient means 80 mounted within the housing 70, and a driver 90 pivotally mounted with the housing 70 and operatively connected to the resilient means 80.

Figure 5:
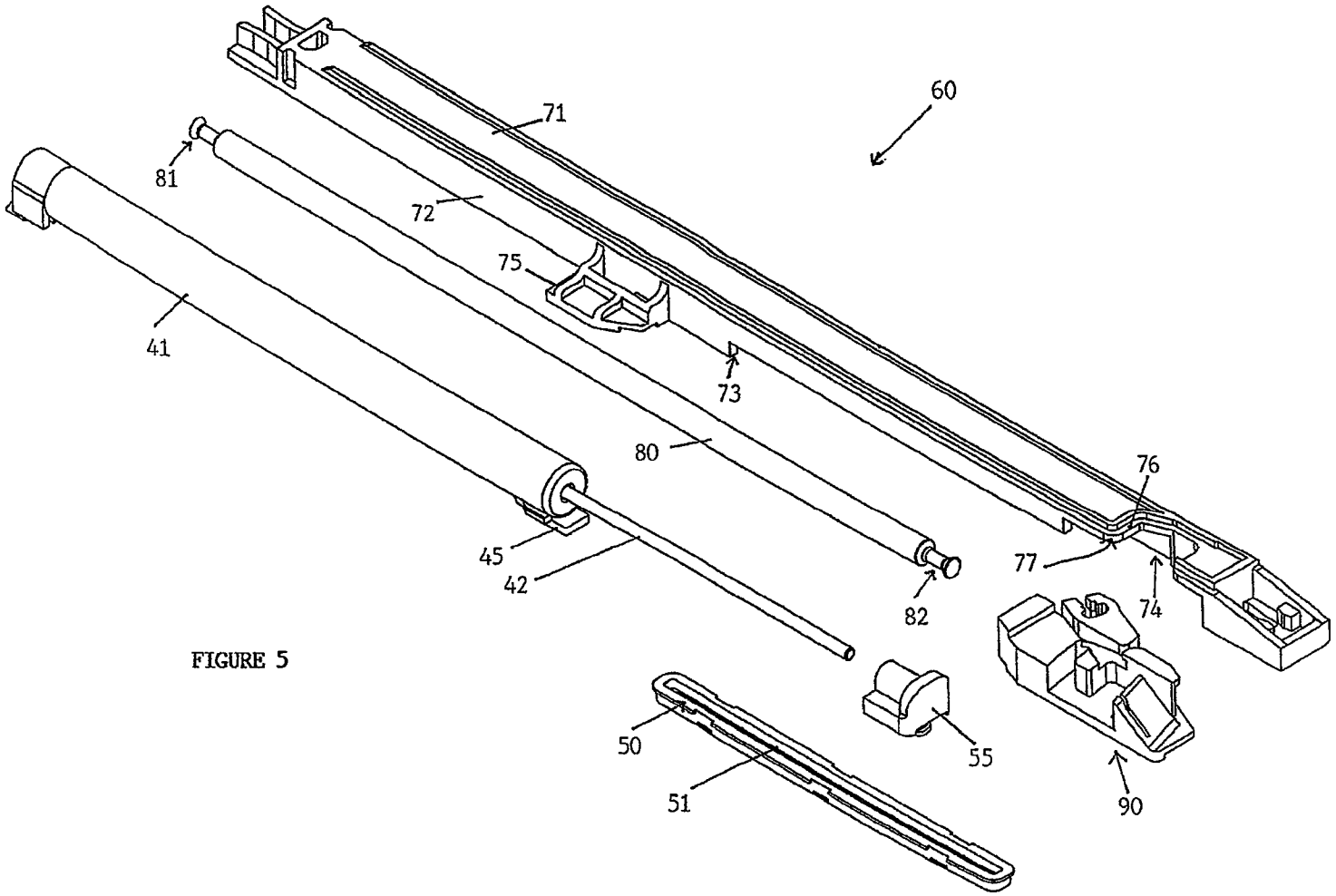
FIG. 5 is an exploded view of the closing device, damping device and channel guide of FIG. 4.
Figure 6B:
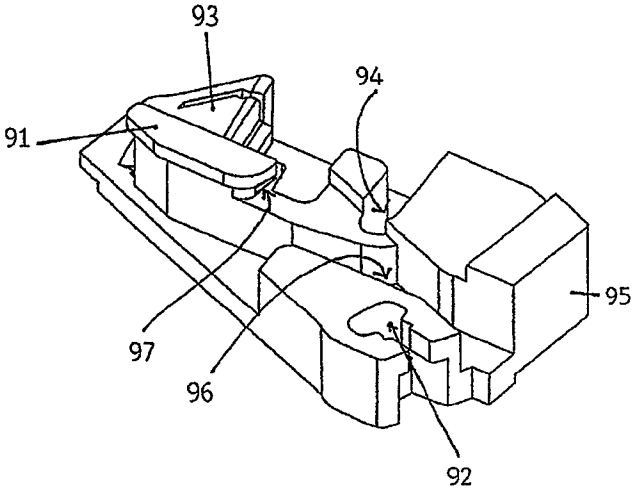
FIGS. 6A and 6B show front and rear views of the driver of the closing device of FIG. 1.
Figure 6A:
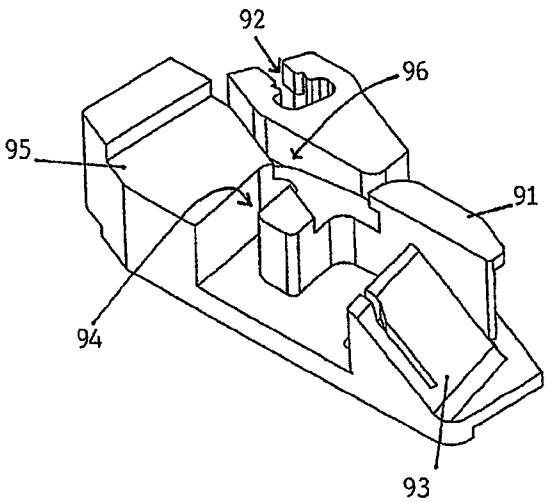

As seen in FIG. 5, the closing device housing 70 is C-shaped with a pair of side flanges and a top flange 71. The housing 70 is affixed to the mounting bracket 10 by way of upwardly bent tabs provided on the horizontal flange 11 of the mounting bracket 10. For ease of discussion, the side flange of the housing 70 facing inward of the assembly, adjacent the damping device 40 and channel guide 50 in use, will be termed as the "inner side flange 72". A sidewardly protruding bracket 75 is provided on the inner side flange 72 of the housing 70. This bracket 75 is provided for removable attachment of the damping device 40 (front attachment bracket 45) to the housing 70 (closing device 60). From approximately the mid-length portion onwards, adjacent the side bracket 75, the inner side flange 72 is of a reduced height, forming a step 73. The function of this inner side flange step 73 will be discussed below. A portion of the inner side flange 72 forward of the step 73 as well as an adjacent portion of the top flange 71 is cut-out, forming a recess 74 for receiving the driver 90. This recess 74 is located near the front longitudinal end of the housing 70. A lip 76 is provided along a top edge of the recess 74. A corner 77 of the recess is engageable with a portion of the driver 90, in use, to define the front linear travel limit of the driver 90.

The resilient means 80 (preferably a spring) is enclosed within the housing 70, with its rear longitudinal end 81 mounted in a receiver (not shown) provided at the rear of the housing 70. The front longitudinal end 82 of the resilient means 80 is suitably shaped and loosely fitted within a correspondingly shaped socket 92 (spring catch) provided at a rear corner of the closing device driver 90 such that the driver is pivotable about a horizontal axis The pivotable driver 90 (FIGS. 6A and 6B) is substantially wedge-shaped with the above-mentioned spring catch 92 provided at one rear corner and an abutment projection 95 provided at the other rear corner. The abutment projection 95 has a flat face that contacts and engages the sliding member abutment face 59, in use. A hook 91 is provided forward of the spring catch 92, along a side of the driver 90. The rear portion 97 of hook 91 is engageable with corner 77 of the housing 70, in use. A resilient tongue 93 is provided on the front of the driver 90. An angular slot 94 is provided on the top surface of the driver 90 for receiving the guiding pin 35 of the pull out rail 30. The abutment projection 95 and spring catch 92 are spaced apart at the rear of the driver 90 such that a guide groove 96 is defined therebetween. This guide groove 96 aids in guiding the pivoting movement of the driver 90.

During assembly, firstly, the damping device 40 and channel guide 50 (with sliding member 55) are mounted onto the mounting bracket horizontal flange 11, adjacent the fixed rail 15. The closing device 60 is separately assembled prior to mounting onto the mounting bracket 10.

The front end 82 of the resilient means 80 is firstly inserted into the spring catch 92 of the driver 90. Subsequently, the resilient means-driver configuration is mounted to the housing 70 with the rear end 81 of the resilient means 80 fixed to the receiver at the rear of the housing 70, the housing inner side flange 72 inserted within the driver guide groove 96 and the front and side of the driver 90 fitted within the housing recess 74. The pivoting movement of the driver 90 about a horizontal axis at its pivot point (spring catch 92) is guided by interaction of the inner side flange 72 against the opposing surfaces of the guide groove 96. The degree of movement of the driver 90 about its pivot point is determined by the curvature of the guide groove 96. The driver 90 is locked with the housing 70 by engaging its hook 91 onto the recess lip 76 such that the driver 90 is in its first locked position.

The closing device housing 70 (with resilient means 80 and driver 90 mounted thereto) is then fixed onto the mounting bracket horizontal flange 11, to a side of the damping device-channel guide configuration. The closing device housing 70 is mounted on the mounting bracket 10 by sliding it rearwardly until the front attachment bracket 45 of the damping device 40 is inserted beneath the side bracket 75 of the closing device housing 70. In this position, a corner of the driver abutment projection 95 rests against the sliding member abutment face 59.

In use, when the drawer is in a fully opened position (FIGS. 1, 2, 8), the pull out rail 30 is in a fully extended position and the sliding member 55 is at its front travel limit abutting against the front end of the channel guide 50. In this state, the rod 42 of the damping device 40 with its distal end located within the sliding member 55 runs along the length of the channel guide 50. The driver 90 is in its first locked position (hook 91 engaged to recess lip 76) and a corner of its abutment projection 95 is resting against the abutment face 59 of the sliding member 55.

Figure 8:
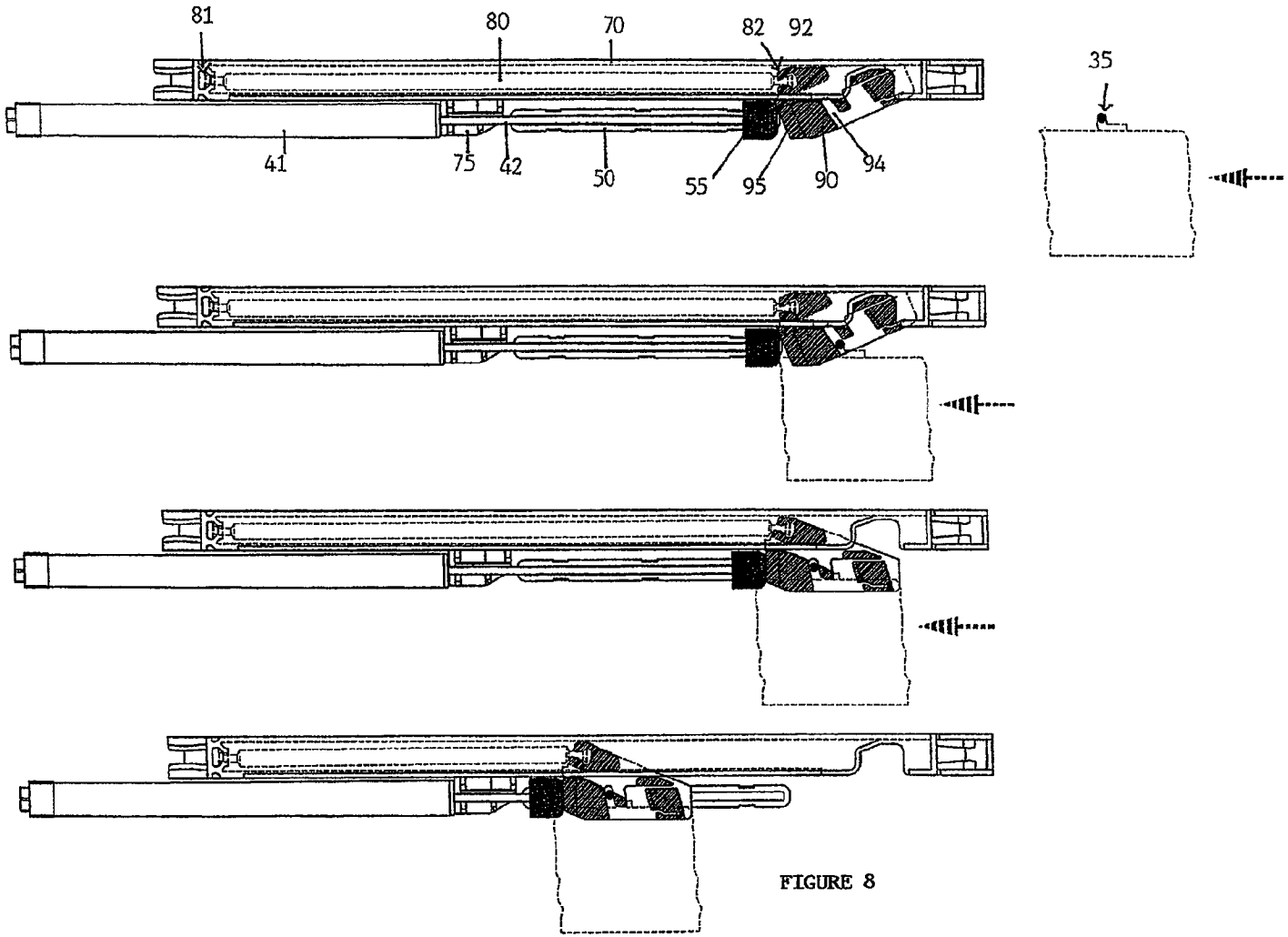
FIG. 8 shows a top view of the assembly of the embodiment of FIG. 1 as the drawer is initially in a fully opened position and subsequently pushed into a fully closed position.

The pull out rail 30 is caused to slide in a drawer-closing direction as the drawer is pushed in (FIG. 8). At a predetermined point, the guiding pin 35 of the pull out rail 30 will come in contact with the closing device driver 90 at the opening of its angular slot 94. As the drawer is pushed further in, the guiding pin 35 enters the angular slot 94 and the action of the pin 35 within the slot 94 causes the driver 90 to pivot about a horizontal axis, releasing it from its first locked position, to a second position where it is linearly moveable in a rearwardly direction under bias of the resilient means 80.

Further rearward movement of the drawer (pull out rail 30) causes the guiding pin 35 to be engaged within the angular slot 94. In this state, the closing action of the guide rail system (and the drawer) is aided by the action of the closing device 60.

When the driver 90 is in its second position, its abutment projection 95 fully abuts against and engages the abutment face 59 of the sliding member 55. Thereafter, rearward linear movement of the driver 90 (and drawer) urges the sliding member 55 to slide rearwardly within the channel guide 50. The sliding motion of the sliding member 55 in turn, causes the damping device 40 to be compressed in a lengthwise direction as the damping device rod 42 is pushed into the cylinder body 41. Thus, the sliding motion of the sliding member 55 against the resilience of the damping device 40 will result in the deceleration of the drawer-closing motion. The rearward movement of the closing device driver 90 is halted when the drawer front panel (not shown) abuts against the drawer sides (not shown) i.e. drawer fully closed position.

The pull out rail 30 sliding motion is halted at its rear travel limit as the abutment surface of its stopper piece 34 engages the stopper tab of the mounting bracket 10. Due to the location of the mounting bracket stopper tab such that it is forward relative to the rear travel limit position of the sliding member 55, the sliding member 55 continues to be slidable even though the pull out rail 30 is at its rear travel limit and as such, stationary. The rear travel limit of the sliding member 55 is defined by the rear longitudinal end of the channel guide 50.

There are exceptional circumstances where the closing device driver 90 is caused to pivot from its first locked position to its second linearly moveable position, without engagement of the pull out rail guiding pin 35 within its angular slot 94 (e.g. excessive force is exerted onto the guide rail system or human error during assembly). The inner side flange step 73 of the closing device housing 70 acts as a rear travel limit (or stopper) for the linear movement of the driver 90. In such instances, when the drawer is pushed in, the guiding pin 35 will come into contact with the resilient tongue 93 of the closing device driver 90. As further force is exerted, the resilient tongue 93 will flex downwards enabling the guiding pin 35 to be engaged within the angular slot 94. Thereafter, the guide rail system (and closing device 60) functions as explained above.

When the drawer is in a fully closed position, the pull out rail 30 is at its rear travel limit with the abutment surface of its stopper piece 34 engaged with the mounting bracket stopper tab and its guiding pin 35 engaged within the angular slot 94 and the closing device driver 90 is in its second position. The damping device 40 is in a compressed state (majority length of the rod 42 with its distal end located within the sliding member 55 pushed into cylinder body 41) and the sliding member 55 is engaged with the closing device driver 90 (sliding member abutment face 59 fully abuts against the driver abutment projection 95).

As the drawer is pulled out, the pull out rail 30 is caused to slide in a drawer-opening direction. The action of the guiding pin 35 within the angular slot 94 moves the closing device 60 linearly in a drawer opening direction, against the action of the resilient means 80. At the same time, the damping device 40 decompresses in a lengthwise direction and the rod 42 will be pushed out of its cylinder body 41. As the distal end of the rod 42 is located within the sliding member 55, decompression of the damping device 40 will urge the forward sliding motion of the sliding member 55 within the channel guide 50.

When the driver 90 reaches its front linear travel limit (when rear portion 97 of hook 91 of the driver 90 engages with recess corner 77 of the housing 70), further pulling of the drawer, will result in the guiding pin 35 acting within the angular slot 94 to cause the driver 90 to pivot about a horizontal axis from its second position to its first locked position. Thereafter, the guiding pin 35 will be disengaged from the angular slot 94 to enable the drawer to be fully opened.

All directional statements such as front/forward, back/rear, top, bottom, lateral, inward, outward, made herein are relative to the orientation of the drawer guide rail system, in use.

As will be readily apparent to those skilled in the art, the present invention may easily be produced in other specific forms without departing from its scope or essential characteristics. The present embodiments are, therefore, to be considered as merely illustrative and not restrictive, the scope of the invention being indicated by the claims rather than the foregoing description, and all changes which come within therefor intended to be embraced therein.

The invention claimed is:

1. A guide rail system for slidably opening and closing a drawer within an enclosure, the system comprising:

a mounting bracket for fixing said system to the enclosure, said mounting bracket having a fixed rail for receiving an intermediate rail;

an intermediate rail capable of sliding back and forth relative to said mounting bracket fixed rail;

a pull out rail for attachment to the drawer and being capable of sliding back and forth on said intermediate rail, the pull out rail having a guiding pin on its bottom surface;

a damping device and a channel guide disposed along the mounting bracket, said damping device being resiliently compressible in a lengthwise direction and said channel guide having a sliding member, the sliding member adapted to travel along the channel guide and locate an end of the damping device that can be pushed inwardly to provide damping; and a closing device disposed along the mounting bracket, said closing device comprising a housing, a resilient means disposed within said housing, and a driver pivotally mounted with said housing and operatively connected to said resilient means, the driver pivotable between a first locked position and a second linearly moveable position, and including an angular slot for receiving the guiding pin and an abutment projection contactable with said sliding member;

wherein, during a closing action, the pull out rail is caused to slide in a drawer-closing direction, and when said guiding pin reaches and engages with the angular slot, the action of the guiding pin within the angular slot causes the driver to be pivoted from its first locked position to its second linearly moveable position where said abutment projection engages with the sliding member, and thereafter, linear movement of the driver urges the sliding member to correspondingly travel along said channel guide against the resilience of said damping device, resulting in deceleration of the closing action; and the driver further comprising a resilient tongue contactable with said guiding pin when the driver is caused to pivot from its second linearly moveable position without engagement of said pin within the angular slot.

2. A guide rail system as claimed in claim 1, wherein said damping device comprises a cylinder body and a rod that is pushable into the cylinder body when the device is compressed, the distal end of the rod being located in the sliding member.

3. A guide rail system as claimed in claim 1 wherein said damping device is a fluid damper.

4. A guide rail system as claimed in claim 1, wherein said channel guide has an open top such that the sliding member extends through the open top of the channel guide and locates an end of the damping device through a longitudinal end of the channel.

5. A guide rail system as claimed in claim 1, wherein said sliding member further comprises a chamber for receiving said end of the damping device.

6. A guide rail system as claimed in claim 5 wherein said sliding member further comprises an abutment face contactable with said abutment projection of said closing device driver.

7. A guide rail system as claimed in claim 6 wherein said chamber and abutment face are disposed on opposing ends of said sliding member.

8. A guide rail system as claimed in claim 1 wherein said closing device is disposed to a side of the damping device and channel guide, on the mounting bracket.

9. A guide rail system as claimed in claim 1 wherein said closing device housing is C-shaped comprising a pair of side flanges and a top flange.

10. A guide rail system as claimed in claim 9 wherein said closing device housing further comprises a bracket on one of said side flanges for removably attaching the damping device to the closing device.

11. A guide rail system as claimed in claim 1 wherein said closing device housing further comprises a recess for receiving the driver.

12. A guide rail system as claimed in claim 11 wherein said recess is provided with a lip portion and the driver is provided with a corresponding hook portion engageable with said lip portion, to lock the driver in its first locked position.

13. A guide rail system as claimed in claim 1 wherein said driver further comprises a catch for receiving an end of said resilient means, both the catch and the end of the resilient means received therein being suitably shaped so as to enable the driver to be pivotable about a horizontal axis.

14. A guide rail system as claimed in claim 1 wherein said driver further comprises a guide groove, a housing side flange insertable within said groove in use, for guiding the pivoting movement of said driver.

15. A guide rail system as claimed in claim 1, wherein said intermediate rail comprises a C-shaped guide that is slidable along the mounting bracket fixed rail and a channel piece disposed on top of said C-shaped guide, whereby said pull out rail is slidable along said channel piece of said intermediate rail.

16. A guide rail system as claimed in claim 1, wherein the fixed rail and pull out rail each further comprises a slidable housing having a plurality of rollers that enables the intermediate rail to be slidable on the fixed rail and the pull out rail to be in turn slidable on the intermediate rail.

* * * * *